United States Patent [19]

Bessey

[11] 4,339,067

[45] Jul. 13, 1982

[54] TRIANGULAR PRISMATIC CARTON

[75] Inventor: Dorothy K. Bessey, Charlotte, N.C.

[73] Assignee: Rexham Corporation, Charlotte, N.C.

[21] Appl. No.: 221,447

[22] Filed: Dec. 30, 1980

[51] Int. Cl.[3] ..... B65D 5/06; B65D 5/10

[52] U.S. Cl. ..... 229/22; 229/41 C

[58] Field of Search ..... 229/22, 41 C, 41 D, 229/18

[56] References Cited

U.S. PATENT DOCUMENTS

| | | | |
|---|---|---|---|
| 571,512 | 11/1896 | Davidson | 229/18 |
| 2,372,312 | 3/1945 | Buttery | 229/41 C |
| 2,913,161 | 11/1959 | Travis | 229/22 |
| 3,038,649 | 6/1962 | Rausing | 229/17 |
| 3,084,844 | 4/1963 | Rattner | 229/22 |
| 3,184,146 | 5/1966 | Hurley | 229/41 |
| 3,185,378 | 5/1965 | Rosenburg, Jr. | 229/22 |
| 3,482,760 | 12/1969 | Pascus et al. | 229/22 |

OTHER PUBLICATIONS

"Warner Packaging Idea No. 103".

*Primary Examiner*—William Price
*Assistant Examiner*—Gary E. Elkins
*Attorney, Agent, or Firm*—Mandeville and Schweitzer

[57] ABSTRACT

A display carton in the form of a prism with triangular bases and a recessed, outwardly bowed front face is disclosed herein.

3 Claims, 7 Drawing Figures

FIG. 2
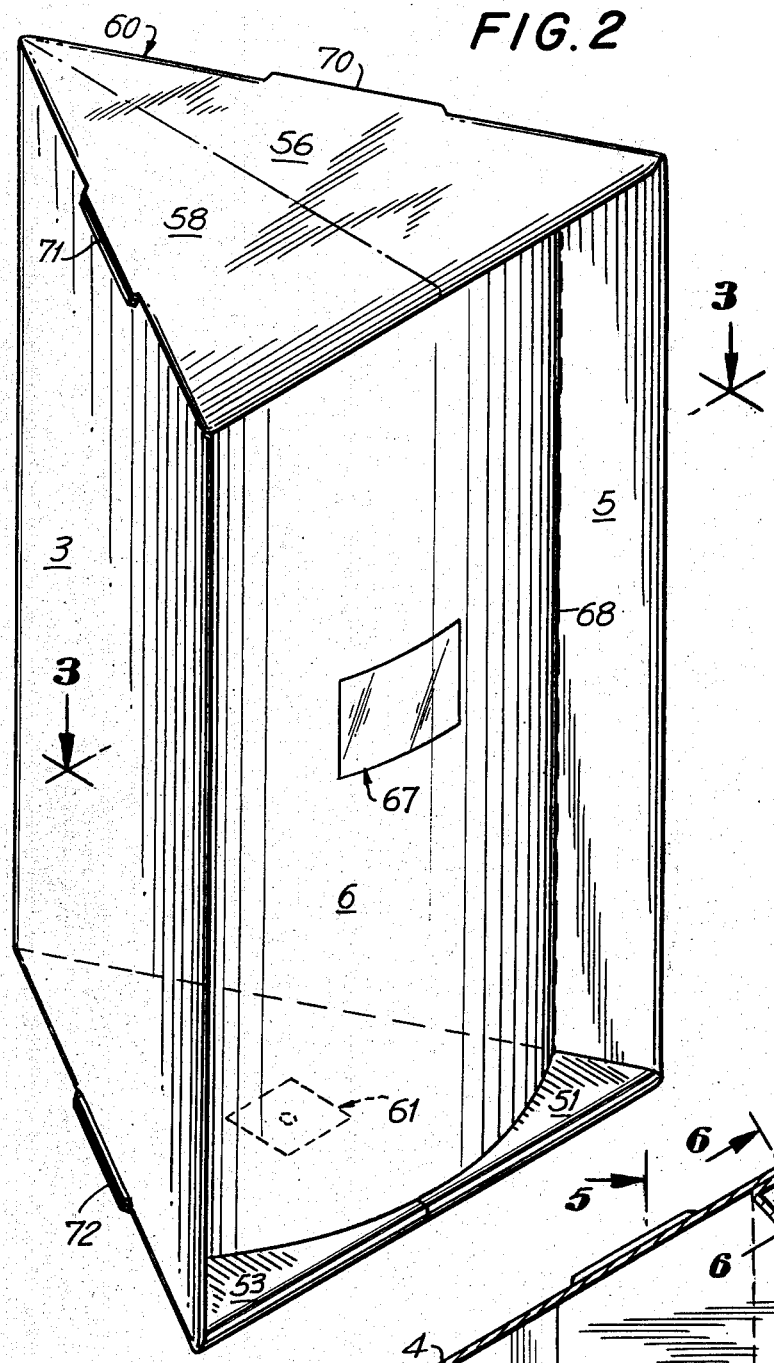
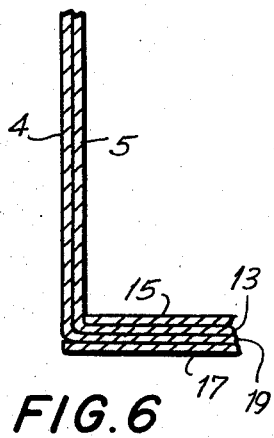
FIG. 6
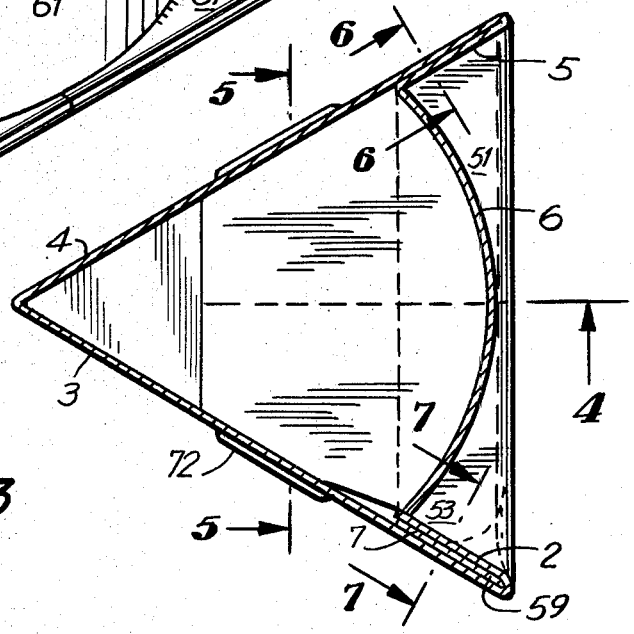
FIG. 3

TRIANGULAR PRISMATIC CARTON

BACKGROUND OF THE INVENTION

Cartons erected from paperboard blanks for displaying articles are well known in the art, and appear in various configurations depending on the article to be displayed. Important considerations in the design of these cartons are sturdy construction, attractiveness, and the capability to be simply erected from easily glued collapsed tubes. Examples of prior cartons in the shape of triangular prisms are disclosed in U.S. Pat. Nos. 3,185,378 and 3,482,760.

SUMMARY OF THE INVENTION

The present invention is directed to an improved triangular prismatic paperboard display carton having recessed, outwardly bowed front face. The blank from which the carton is erected is cut and scored, and then partially assembled by gluing the ends on a conventional right angle gluer. In this stage, it is folded flat for storage and shipping, but it may be readily opened with the ends pulled automatically into position. This is accomplished by a reverse fold in the ends. The front face is recessed by having the panel folded in partially before extending it across the face.

BRIEF DESCRIPTION OF THE DRAWINGS

FIG. 2 is a perspective view of an erected carton embodying the present invention.

FIG. 3 is a top cross-sectional view of the new carton along line 3—3 in FIG. 2.

FIG. 6 is a partial cross-sectional view of the new carton along line 6—6 in FIG. 3.

DETAILED DESCRIPTION OF THE INVENTION

Figure 1:
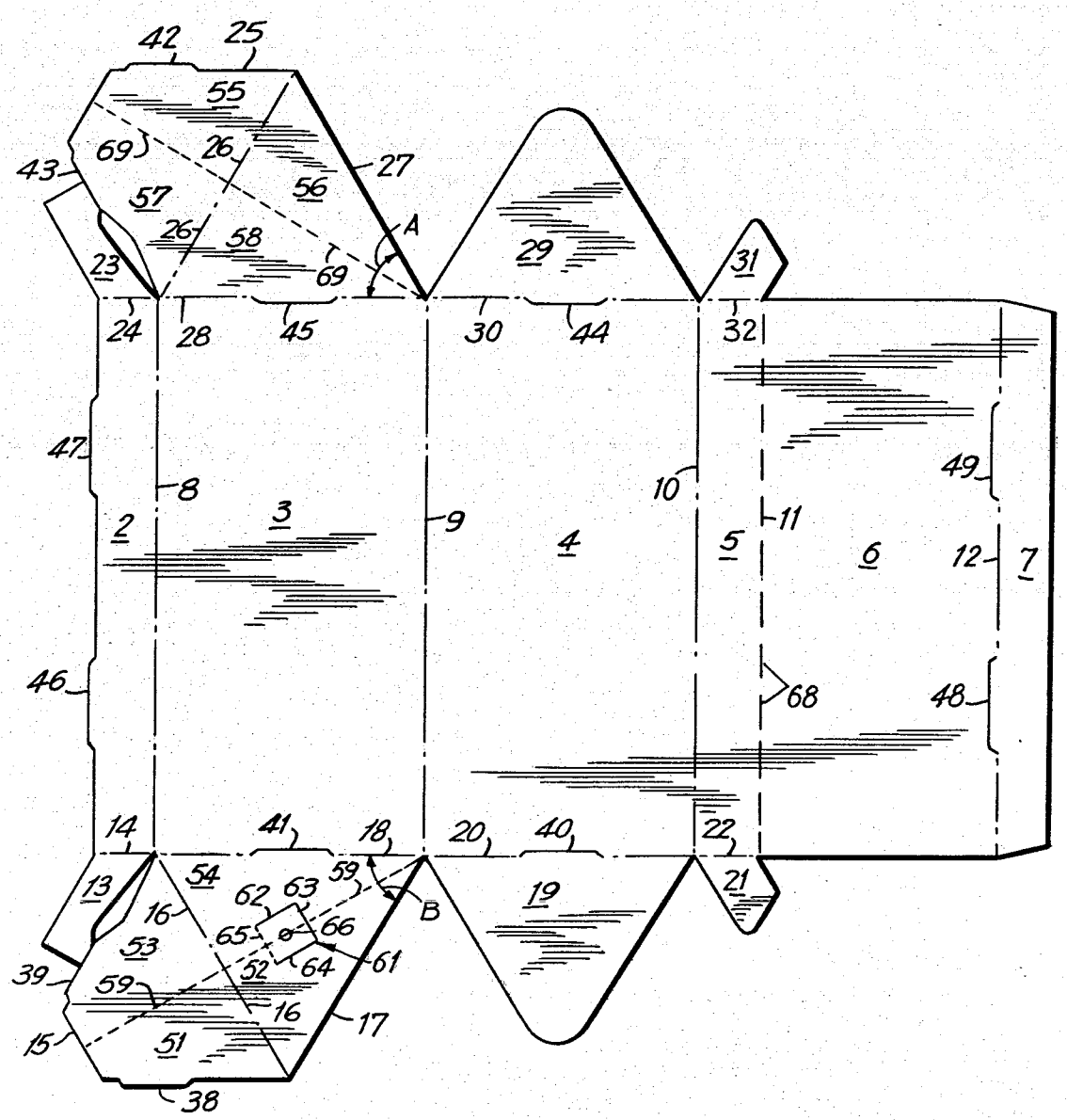
FIG. 1 is a plan view of a cut and scored blank from which the new and improved carton may be erected.

In referring to the drawings for the description and construction of the new carton, width corresponds to horizontal dimensions on the drawings, while length corresponds to vertical dimensions. Rotation out of the plane toward the reader is termed inward rotation, while rotation away from the reader is termed outward rotation. The surface initially facing the reader is termed the interior surface, while the opposite surface is termed the exterior surface.

Referring to FIG. 1, the blank 1 from which the new carton is erected includes, as main panels, from left to right, a closure panel 2, a first side panel 3, a second side panel 4, a recess panel 5, a front panel 6 and a closure flap 7, all having the same length.

These are separated by scorelines 8, 9, 10, 11, and 12, in order. Closure tab 7 may have tapered widthwise edges to facilitate assembly.

Symmetrical extensions on the top and bottom of the main panels are positioning tabs 23, 13, bracing panels 27,17, bracing flaps 25,15, end flaps 29,19 and positioning tabs 31,21. The top extensions are separated from the main panels by a continuous straight scoreline formed from scorelines 24, 45, 44 and 32, reading from left to right. Symmetrical score lines on the bottom are 14,41,40 and 22.

Bracing flaps 25 and 15 have two tuck flaps each, 42,43 and 38,39 respectively. These are designed to be fitted into slits 44,45 in scorelines 30,28 on top, and slits 40,41 in score lines 20,18 on the bottom during assembly, as will be described later.

Similarly, closure panel 2 has tuck tabs 46,47 which are fitted into slits 48,49 in scoreline 12 during assembly, as will also be described later.

Bracing panel 27 is separated from bracing flap 25 by scoreline 26. Perpendicular to scoreline 26 and bisecting angle A is scoreline 69. Symmetrically, bracing panel 17 is separated from bracing flap 15 by scoreline 16, and scoreline 59 bisects angle B. As will be shown later, scorelines 59,69 permit the carton 60 to be partially assembled and glued, while folded flat for shipping and storage.

Scoreline 11 has a pluraliy of perforations 68 to facilitate folding along this scoreline.

In accordance with the invention, the blank 1 may be formed into a carton as follows:

End flap 19 is rotated inwardly 180° about scoreline 20 until it lies directly upon side panel 4. End flap 29 is rotated inwardly 180° about scoreline 30 until it lies directly upon side panel 4.

The folded extensions formed from bracing panels 27,17 and bracing flaps 25,15 are rotated inwardly 180° about scoreline 28 and 18 respectively. Bracing panel 27 and bracing flap 25 are folded in half by folding them outwardly 180° about scoreline 69 until the exterior surfaces of subpanels 55,56 touch the exterior surfaces of subpanels 57,58. Similarly, bracing panel 17 and bracing flap 15 are folded outwardly 180° about scoreline 59 until the external surfaces of subpanels 51,52 touch the exterior surfaces of subpanels 57,58.

Side panel 3 is then rotated inwardly 180° about scoreline 9 until the interior surface of subpanel 56 lies flat upon the exterior surface of end flap 29, and the interior surface of subpanel 52 lies flat upon the exterior surface of end flap 19. These touching surfaces are then glued together.

With the blank 1 formed into a collapsed, flat folded tube it may be economically shipped and stored before it is erected and filled.

Figure 4:
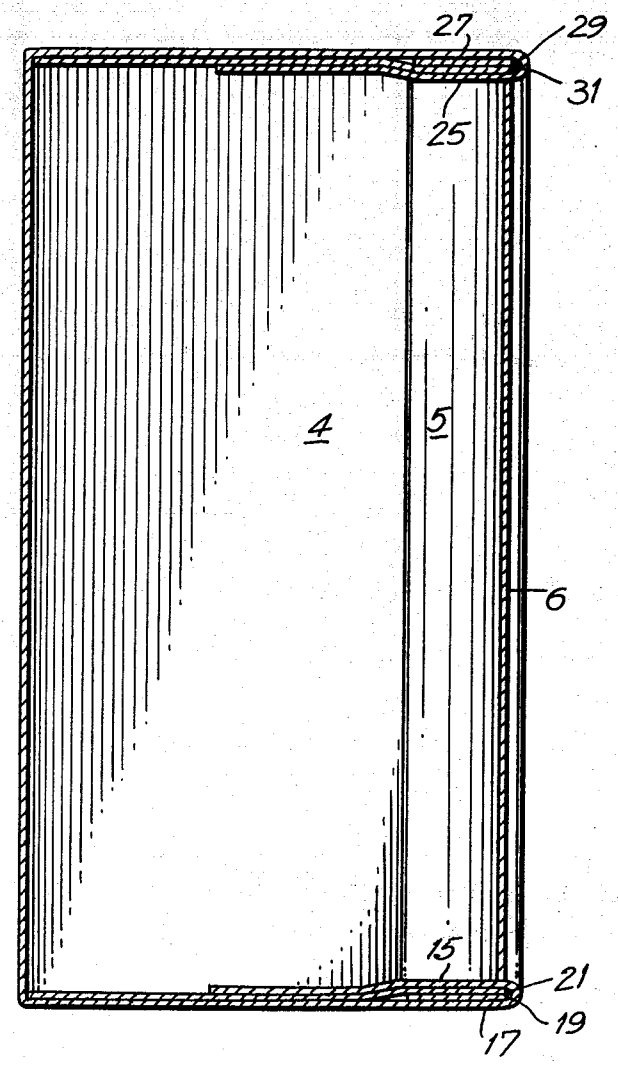
FIG. 4 is a cross-sectional view of the new carton along line 4—4 in FIG. 3.

To complete the formation of the cartion 60, the collapsed tube is squared. Closure panel 2 is then folded inwardly flat onto the interior surface of side panel 3 along scoreline 8, as in FIG. 3. Positioning tabs 13 and 23 will then lie flat with their interior surfaces touching the interior surfaces of end flaps 19 and 29, respectively, as shown in FIG. 4.

Front panel 6 is rotated outwardly 180° about scoreline 11 until the exterior surface of front panel 6 lies on the exterior surface of indent panel 5.

Indent panel 5 is then rotated inwardly about scoreline 10 until the interior surface of indent panel 5 rests on the interior surface of side panel 4 as in FIG. 3. During this rotation, front panel 6 retains its previous relationship to indent panel 5. Positioning tabs 21 and 31 will then lie flat with their interior surfaces touching the interior surfaces of end flaps 19 and 29, respectively, as shown in FIG. 4.

Bracing flap 15 is then folded inwardly along scoreline 16 until it lies flat with its interior surface touching the interior surface of end flap 19. Tuck tabls 38,39 on the bracing flap 15 are inserted in slits 40,41 along scorelines 18,20 respectively, thus holding the three layer combination of bracing panel 17, end flap 19 and bracing flap 15 in place.

Figure 7:
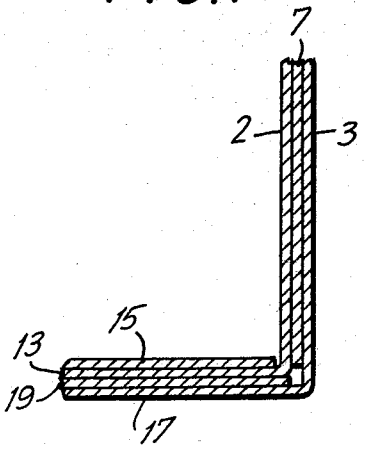
FIG. 7 is a cross-sectional view of the new carton along line 7—7 of FIG. 3.
Figure 5:
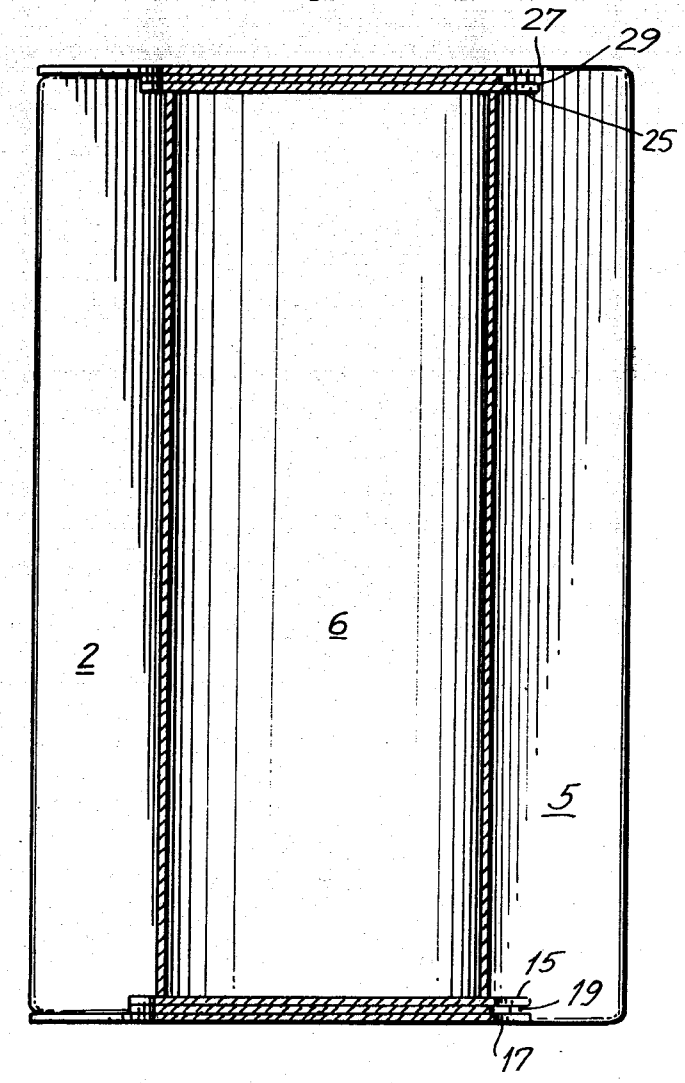
FIG. 5 is a front cross-sectional view of the new carton along line 5—5 in FIG. 3.

Similarly, bracing flap 25 is folded inwardly along scoreline 26 until it lies flat with its interior surface touching the interior surface of end flap 29. Tuck tabs 42,43 on the bracing flap 25 are inserted into slits 44,45, along scorelines 30,28 respectively. See FIGS. 5, 6, and 7.

The carton 60 is now fully assembled except for closing the front panel so the article to be packaged is now placed in the carton. The closure panel 2 and side panel 3 form an interior pocket 59, shown in FIG. 3, running the length of the carton 60. To close the front panel 6, closure tab 7 is inserted into this pocket 59. Since the front panel 6 is wider than the indented front distance it spans, it will be forced to bow. Gentle outward pressure on the inside surface of the front panel 6 while the closure tab 7 is being inserted will cause the front panel 6 to bow outwardly, thereby creating in the completed carton an appealing and distinctive shape coupled with a sturdy construction. When the closure tab 7 is fully inserted, tuck tabs 46,47 on the closure tab 7 are inserted into slits 48,49 along scoreline 12, thus preventing the casual dislodgement of closure tab 7. The erected carton is shown in FIG. 2.

In a preferred embodiment, one of the bracing panels, e.g. 17, has a hang tab 61, shown in FIG. 1, created by three short cuts 62,63,64 forming three sides of a rectangle and a scoreline 65 forming the fourth side. A circular hole 66 is punched in the center of the tab 61. During shipping and storage, this tab 61 is left in the plane of the bracing panel 17, but for displaying the carton 60 by hanging it from a display rack, the tab 61 is erected by pulling it from the bracing panel 17 and rotating it about scoreline 65 until it is perpendicular to the bracing panel 17. The hook of a display rack is then threaded through the hole 66, so that the carton 61 is attractively displayed.

An additional feature is the presence of a window 67, shown in FIG. 2, in either of the side panels 3,4, or the front panel 6. This enables the consumer to see the packaged article, without interfering with the assembly or construction of the carton.

For a symmetrical carton with a base in the shape of an equilateral triangle, it will be readily seen that side panels 3,4 are then of equal width, bracing panels 27,17 are equilateral triangles with sides equal to the width of the side panels and angles A and B are each 60°. Also end flaps 29,19 and bracing flaps 25,15 are all substantially in the form of equilateral triangles congruent to the bracing panels 27,17 and positioning tabs 23,13 and 31,21 are offset from the vertical by 30°, away from bracing panels 27,17 and end flaps 29,19 respectively.

For a symmetrically inset front panel 6, indent panel 5 has the same width as closure panel 2.

As can be seen from FIG. 2, the new and improved carton has an unusual and appealing shape. It is distinctive in that it is not based on a standard rectangular solid, but has a noticeably different form while retaining a pleasing symmetry. It can be assembled on a conventional right angle gluer, and after shipping only a manual lock is necessary to compete the erection of the carton. This carton, by its distinctiveness, is well adapted for displaying items such as shampoo, bath salts, cosmetics, as well as expensive pantyhose and similar items.

I claim:

1. A display carton in the shape of a generally triangular prism, comprising:

(a) two rectangular first and second side panels and a rectangular bowed front panel, all having the same length;

(b) the first side panel being articulated to the second side panel along respective first lengthwise edges at an angle of less than 180°, forming an interior within the side panel, having the same length;

(c) a rectangular indent panel, having the same length as but a lesser width than the first side panel articulated along a first lengthwise edge to the first side panel's second lengthwise edge;

(d) the indent panel lying on the interior surface of the first side panel;

(e) said front panel articulated along a first lengthwise edge to the second lengthwise edge of indent panel;

(f) a rectangular closure panel, of the same length as but a lesser width than the second side panel, articulated along a first lengthwise edge to the second lengthwise edge of the second side panel and lying on the inside surface of the second side panel, (g) said front panel being of a width greater than the shortest straight line distance between the second lengthwise edge of the indent panel and the second lengthwise edge of the closure panel;

(h) a rectangular closure tab, at the same length as but having a width no greater than the closure panel, articulated along a lengthwise edge to the second lengthwise edge of the front panel;

(i) the closure tab engaging the closure panel to limit the outward displacement of the front panel within the carton;

(j) top and bottom triangular end flaps articulated to the first side panel along its widthwise edges, substantially filling the triangular area deliminted by adjoining widthwise edges of the side panels;

(k) top and bottom triangular bracing panels articulated to the second side panel along its widthwise edges and completely covering the triangular area, lying on the outside surfaces of the top and bottom end flaps;

(l) said bracing panels having one score line each running the entire distance across the bracing panels and bisecting the angle between the side panels;

(m) tip and bottom bracing flaps articulated to front edges of the bracing panels, substantially covering the triangular area and lying on the inside surfaces of the bracing panels;

(o) said bracing flaps having one score line each running the entire distance across the bracing panels and aligned with the score lines in the bracing panel;

(p) said bracing flaps engaging the side panels to prevent the displacement of the bracing flaps;

(q) first positioning tabs articulated to the widthwise edges of the closure panel and lying between the end flaps and the bracing flaps;

(r) second positioning tabs articulated to the widthwise edges of the indent panel and lying between the end flaps and the bracing flaps.

2. A display carton according to claim 1, further comprising hanging means articulated from one of the bracing panels.

3. A display carton according to claim 1, further comprising a window area located on the front panel.

* * * * *